US005425207A

United States Patent [19]

Shayman

[11] Patent Number: 5,425,207

[45] Date of Patent: Jun. 20, 1995

[54] METHOD OF CONSTRUCTING BUILDINGS AND OTHER STRUCTURES USING CORRUGATED MATERIAL

[76] Inventor: Harry I. Shayman, 175 N. Harbor Dr., Apt. 5405, Chicago, Ill. 60601

[21] Appl. No.: 199,422

[22] Filed: Feb. 22, 1994

[51] Int. Cl.[6] ..... E04B 2/00; E04B 7/00; E04C 2/32; E04C 2/24

[52] U.S. Cl. ..... 52/79.9; 52/91.1; 52/91.3; 52/92.1; 52/631; 52/269; 52/270; 52/309.8; 52/408; 52/295; 52/801; 52/802; 52/804; 52/809; 52/811; 52/814; 52/745.08

[58] Field of Search ..... 52/77.1, 79.9, 309.4, 52/309.8, 309.13, 309.14, 408–411, 795, 801, 802, 804, 809, 811, 814, 262, 265, 267–270, 284, 515, 745.02, 745.08, 91.1, 91.3, 92.1, 631

[56] References Cited

U.S. PATENT DOCUMENTS

| | | | |
|---|---|---|---|
| 1,760,817 | 5/1930 | Creamer et al. | 52/801 X |
| 2,238,022 | 4/1941 | Johnson | 52/795 X |
| 2,330,941 | 10/1943 | Acuff | 52/799 X |
| 2,336,435 | 12/1943 | Zirinsky | 52/262 X |
| 3,051,277 | 8/1962 | Day | 52/270 X |
| 3,368,473 | 2/1968 | Sohda et al. | 52/799 X |
| 3,457,698 | 7/1969 | Albers | 52/270 X |
| 3,482,367 | 12/1969 | Curran | 52/795 X |
| 3,517,468 | 6/1970 | Woods | 52/79.1 |
| 3,555,756 | 1/1971 | Curran et al. | 52/795 X |
| 3,747,290 | 7/1973 | Barrell et al. | 52/90 |
| 3,800,485 | 4/1974 | Yates | 52/90 |
| 3,803,786 | 4/1974 | Schneider | 52/233 |
| 3,883,999 | 5/1975 | Nicholl | 52/90 |
| 3,908,062 | 9/1975 | Roberts | 428/282 |
| 4,081,938 | 4/1978 | Bertacchi et al. | 52/795 X |
| 4,120,131 | 10/1978 | Carroll | 52/310 |
| 4,227,356 | 10/1980 | Stern et al. | 52/309.4 |
| 4,274,239 | 6/1981 | Carroll | 52/443 |
| 4,351,870 | 9/1982 | English Jr. | 428/174 |
| 4,434,592 | 3/1984 | Reneault et al. | 52/809 X |
| 4,463,043 | 7/1984 | Reeves | 428/68 |
| 4,736,566 | 4/1988 | Krotsch | 52/795 |
| 5,309,690 | 5/1994 | Symons | 52/309.9 |

FOREIGN PATENT DOCUMENTS

| | | | |
|---|---|---|---|
| 0194242 | 7/1990 | Japan | 52/795 |

*Primary Examiner*—Carl D. Friedman
*Assistant Examiner*—Robert J. Canfield
*Attorney, Agent, or Firm*—Patula & Associates

[57] ABSTRACT

Pre-fabricated building sections made up of gypsum board laminated to either a double or triple layer of a length of U- or C-shaped corrugated cardboard in approximately two foot widths are fastened together by angled metal stays. The completed sections are used in homes or building constructions. Within the shaped cardboard is a sheet of fireproof foam. Metal stays bolted in place at the ends and corners of corrugated cardboard, used to attach adjacent sections, assist in the rigidity of the resulting building structure.

20 Claims, 7 Drawing Sheets

Fig 6
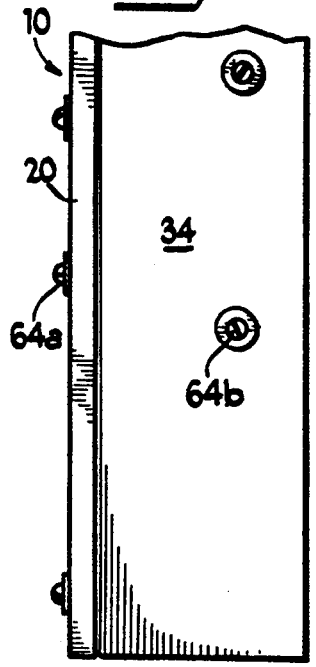
Fig 7
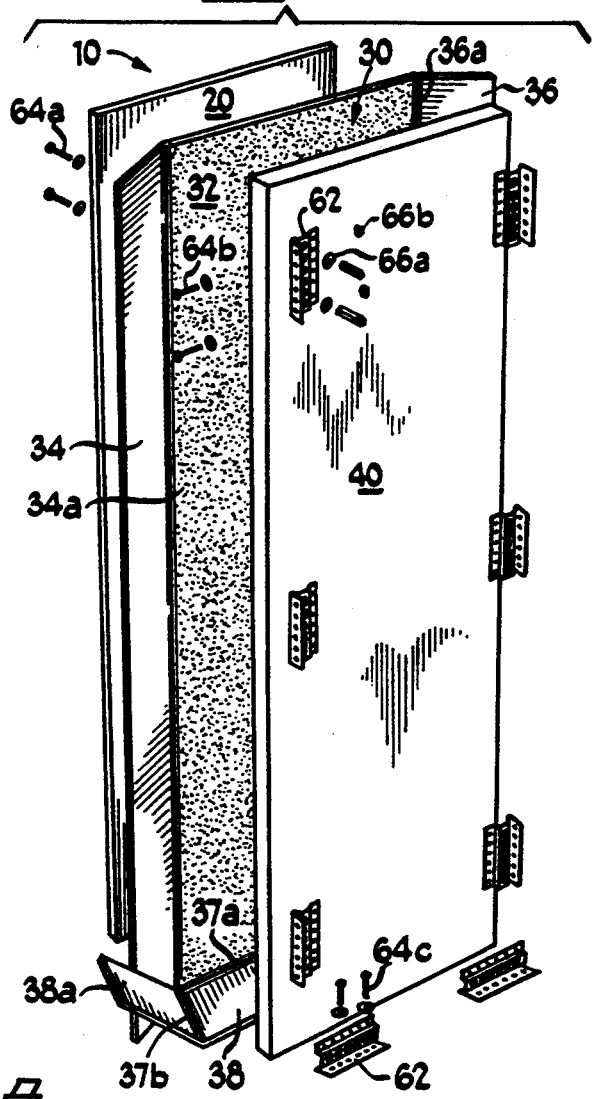
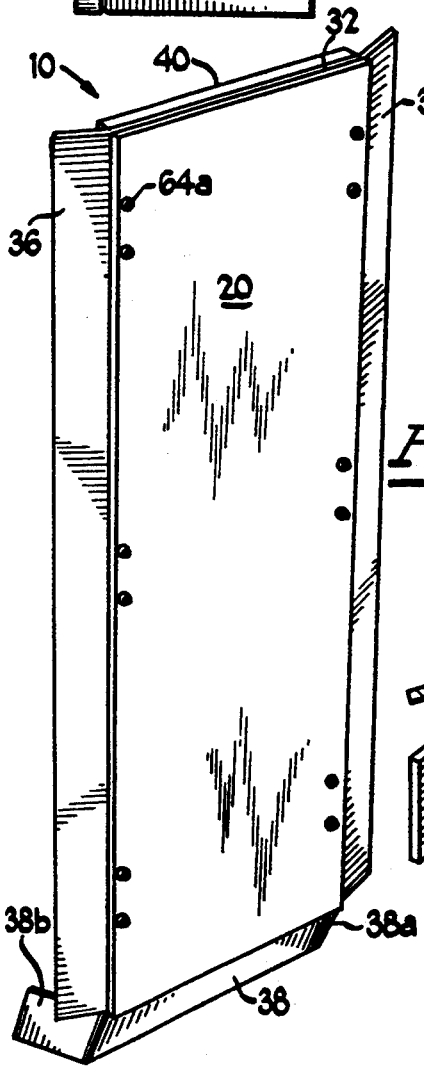
Fig 8
Fig 9
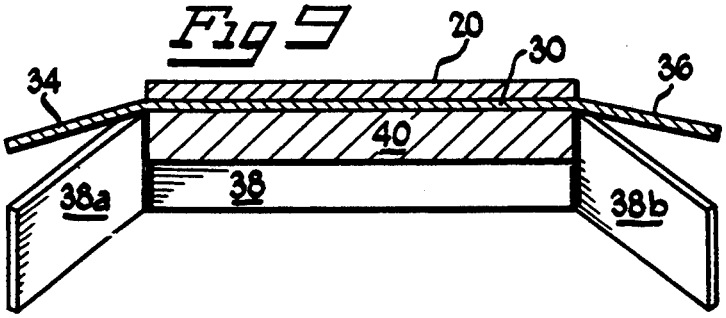

Fig 23
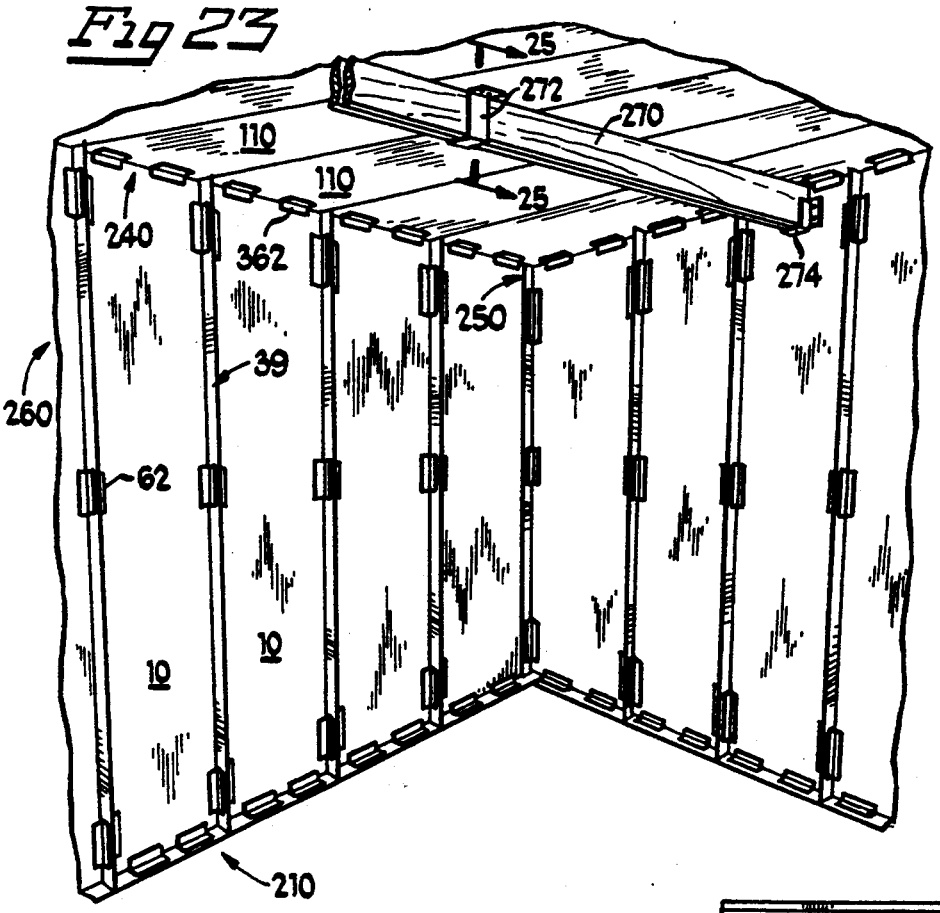
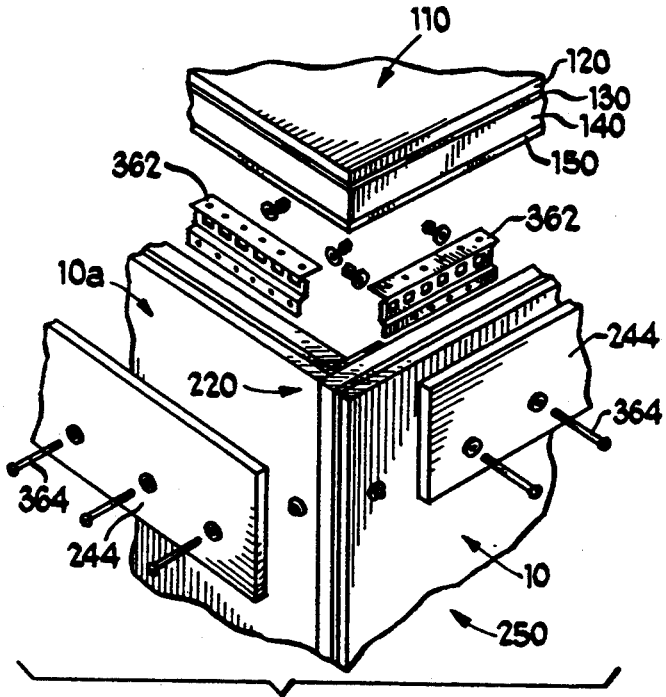
Fig 22
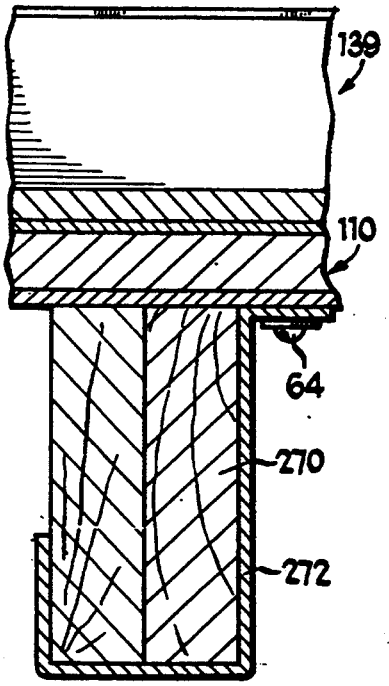
Fig 25

METHOD OF CONSTRUCTING BUILDINGS AND OTHER STRUCTURES USING CORRUGATED MATERIAL

The present invention relates generally to a method of constructing buildings and other structures and, in particular, a quick and inexpensive method of constructing buildings and other structures using corrugated material.

BACKGROUND OF THE INVENTION

The need to quickly construct inexpensive structures such as homes or other types of buildings is ever present. Further, these structures must be soundly built to accommodate the forces of nature including natural disasters and/or man-made disasters such as a fire. For example, should a natural disaster such as a hurricane strike, hundreds or thousands of people might be left without housing. This situation is magnified if such a disaster occurs in a poorer section of the world where many of the people would not have the means necessary to quickly rebuild or relocate. Therefore, there is a need to have numerous housing structures, whether temporary or permanent, to be built in a quick, efficient and inexpensive manner.

Further, these structures must be strong and secure such that they may be lived in safely and permanently if needed or desired. Accordingly, there is a need for a strong, relatively lightweight, inexpensive, fireproof and easy to assemble construction material and method of constructing buildings and other structures. Prior art construction material and systems have failed to adequately meet these needs.

U.S. Pat. No. 5,008,259 issued to Myers discloses a roof construction system. Myers differs from the present invention in that the roof construction system comprises a metal roof deck to which a thin waterproof membrane, a foam insulation, and another water impervious membrane are attached. Myers does not disclose a quick and inexpensive method of constructing buildings using corrugated material as does the present invention.

U.S. Pat. No. 4,052,828 issued to Mancini, et al. discloses a structural member used as a wall between a ceiling and a floor. Mancini, et al. differs from the present invention in that the wall comprises an accordion-like cardboard core sandwiched between two dry wall boards, and utilizes an inverted U-channel to support the wall at its upper end, and a complicated two component support member at its lower end. Mancini, et al. does not disclose a quick and inexpensive method of constructing buildings using corrugated material as does the present invention.

U.S. Pat. No. 3,031,044 issued to Stitt, et al. discloses a fire retardant wall construction. Stitt, et al. differs from the present invention in that the wall comprises two sets of spaced apart panels between which are arranged four panels of fire retardant material and utilizes a complicated clip mechanism to attach the structure. Stitt, et al. does not disclose a quick and inexpensive method of constructing buildings using corrugated material as does the present invention.

U.S. Pat. No. 683,060 issued to New discloses an insulating construction. New differs from the present invention in that the insulating construction comprises a wooden block having a plurality of partitions therein spread or separated by air-spaces. New does not disclose a quick and inexpensive method of constructing buildings using corrugated material as does the present invention.

U.S. Pat. No. 3,192,099 issued to Beckman, et al. discloses a furniture panel. Beckman, et al. differs from the present invention in that the furniture panel comprises a corrugated, foam sandwich core enclosed by a jacket having a decorative exterior. Beckman, et al. does not disclose a quick and inexpensive method of constructing buildings using corrugated material as does the present invention.

U.S. Pat. Nos. 5,215,806 and 5,032,447 issued to Bailey disclose a fire barrier material for use in building construction. Bailey differs from the present invention in that the fire barrier material is used in conjunction with wall, ceiling or floor expansion joint systems. Bailey does not disclose a quick and inexpensive method of constructing buildings using corrugated material as does the present invention.

U.S. Pat. No. 897,158 issued to Ryan discloses a plaster board. Ryan differs from the present invention in that the plaster board comprises of a layer of plaster of paris, a sheet of coarse burlap, a second plaster layer and a second sheet of burlap to which asbestos is applied. Ryan does not disclose a quick and inexpensive method of constructing buildings using corrugated material as does the present invention.

SUMMARY OF THE INVENTION

The present invention relates to the manufacture of a prefabricated building sections which are easily and quickly mounted together to form an entire building or structure. The sections, described in my co-pending U.S. application Ser. No. 08/199,590 for "METHOD OF CONSTRUCTION USING CORRUGATED MATERIAL" are made of gypsum board mounted on either a double or triple layer of a length of U- or C-shaped corrugated cardboard in approximately two foot widths. The completed sections are then used in home or building constructions.

Within the shaped cardboard is a sheet of fireproof foam. Metal stays bolted in place at the ends and corners of the corrugated cardboard, used to attach sections together, assist in the rigidity of the resulting sections and building structures.

A first section, preferably a wall section, is made up of a outer layer of gypsum board laminated to a layer of corrugated, which is laminated to a layer of fireproof or fire resistant foam. The sides of the corrugated fold inward to form the structural studs of the section.

In a second section, preferably a roof section, the outer layer of gypsum board is laminated to a layer of corrugated followed by a layer of foam followed by an additional layer of corrugated. The ends of each layer of corrugated fold outward to form the structural studs of this section. The sections are fastened together at the structural studs.

Accordingly, it is an object of the present invention to provide construction material and a method of constructing buildings and other structures using corrugated material.

It is another object of the present invention to provide pre-fabricated building sections which can be quickly and inexpensively used to construct or form a structure.

It is an additional object of the present invention to provide a building section which is strong and secure with which a structure can be constructed solely out of the material of the pre-fabricated building sections.

It is a further object of the present invention to provide a structure formed from a plurality of fireproof building sections using corrugated material.

It is yet another object of the present invention to provide a method of constructing utilizing pre-fabricated building sections containing corrugated material.

It is a still further object of the present invention to provide a plurality of pre-fabricated building sections which can be quickly assembled into a building or other structure utilizing only a simple tool which can fasten bolts in metal stays.

BRIEF DESCRIPTION OF THE DRAWINGS

A fuller understanding of the foregoing may be had by reference to the accompanying drawings wherein:

FIG. 6 is a partial side elevational view of a wall section;

FIG. 7 is an exploded perspective view of a wall section as seen from the inside surface FIG. 8 is an assembled perspective view of a wall section as seen from the outside surface;

FIG. 9 is a top view of a wall section as seen in FIG. 8;

FIG. 22 is a partially broken away and exploded perspective view of a roof top corner of the present invention;

FIG. 23 is a perspective view of the inside of a building of the present invention;

FIG. 25 is a cross-sectional view of an inside ceiling beam of the present invention.

DETAILED DESCRIPTION OF THE EMBODIMENT

Figure 1:
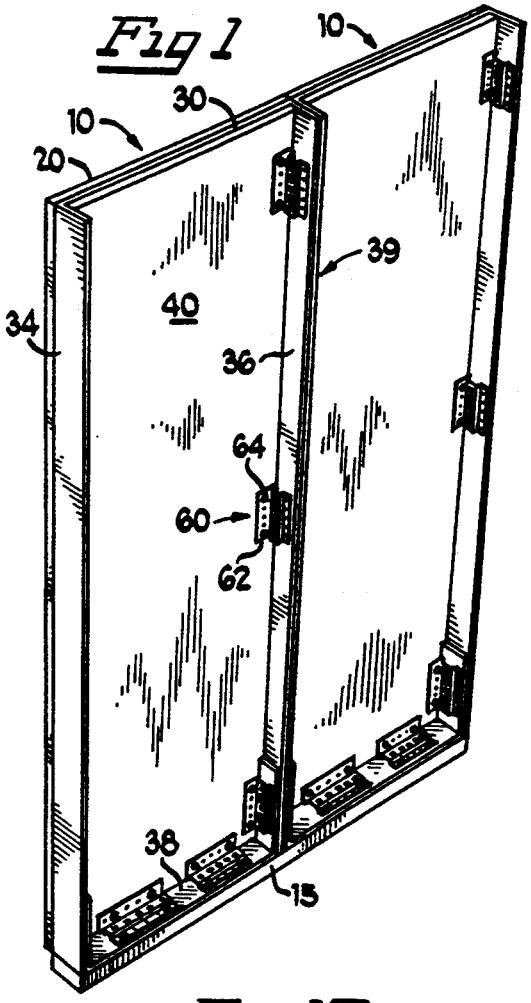
FIG. 1 is a perspective view of two wall sections of the present invention mounted together showing the inside portions of the wall sections.

While the invention is susceptible of embodiment in many different forms, there is shown in the drawings and will be described herein in detail, a preferred embodiment of the present invention. It should be understood, however, that the present disclosure is to be considered an exemplification of the principles of the invention and is not intended to limit the spirit and scope of the invention and/or claims of the embodiment illustrated.

FIGS. 1–12 illustrate generally the wall sections of the present invention. Building wall section 10 is comprised of an outer layer of gypsum board 20 laminated to a middle layer of corrugated 30, which is laminated to an inner layer of fire resistant foam 40. Completed sections are fastened together by fasteners 60 comprised of metal stays 62 and bolts 64.

Figure 13:
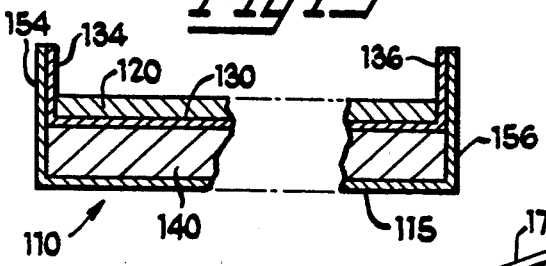
FIG. 13 is a cross-sectional view of a roof section of the present invention.
Figure 14:
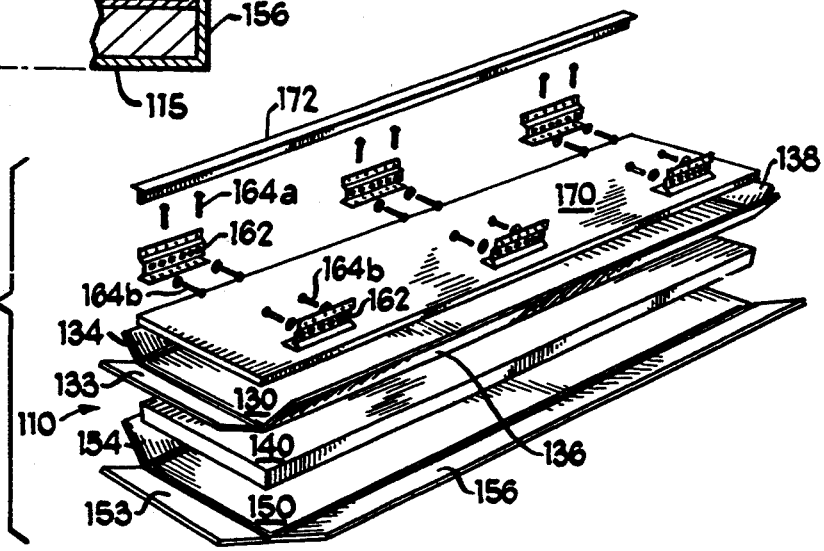
FIG. 14 is an exploded perspective view of the roof section of FIG. 13.

FIGS. 13–14 illustrate generally the roof sections of the present invention. Building roof section 110 is comprised of an outer layer of gypsum board 120 laminated to a middle layer of corrugated 130, which is laminated to a layer of foam 140, which is laminated to an inner second layer of corrugated 150. The completed sections are bolted together by fasteners 160 comprised of metal stays 162 and bolts 164.

FIGS. 15–25 illustrate generally the wall and roof section of the present invention mounted together to form a building.

Referring now to FIG. 1, building wall sections 10 are shown in their assembled form mounted to each other and forming a structural section such as a wall. As can be seen in FIG. 1, building section 10 comprises an outer layer of a rigid fire retardant material or gypsum board 20 laminated or glued to a middle layer of corrugated 30, which is laminated or glued to an inner layer of fireproof foam 40. Foam layer 40 provides rigidity and insulation to the section 10. Middle layer of corrugated 30 includes a main planar section 32, (see FIG. 2), two-side flaps 34, 36, and bottom flap 38. Side flaps are folded inward around inside foam layer 40 to form the wall section sides. Two wall section sides are mounted together to form a wall section stud 39. Bottom flap 38 is folded inward and upward to form the bottom of wall section 10. Section 10 is held in its assembled position by fasteners 60, such as angled metal stays 62 and bolts 64. Section 10 is shown mounted on building base support 15.

Figure 2:
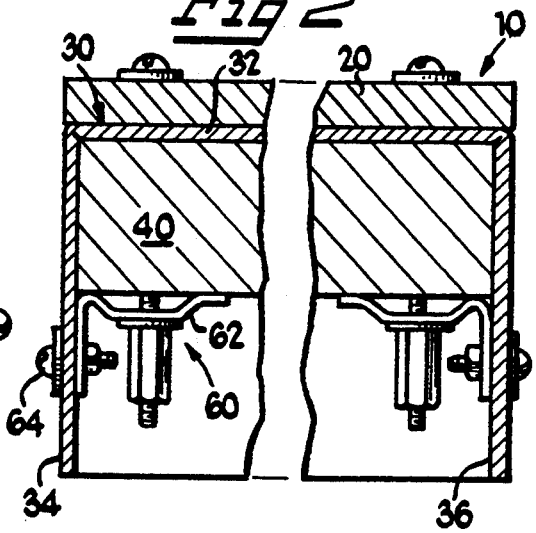
FIG. 2 is a broken top sectional view of a wall section.

FIG. 2 shows a broken top view of wall section 10 comprising outer layer of gypsum board 20, middle layer of corrugated 30, and inner layer of foam 40 laminated together and secured by fasteners 60. As can be seen, side flaps 34 and 36 are mounted in assembled position perpendicular to outer layer of gypsum board 20, main planar section of corrugated 32 and foam layer 40 by angled metal stays 62 and side bolt **64*b*. Layer of gypsum 20, main planar section of corrugated 32 and layer foam 40 are laminated and bolted together by angled metal stays 62 and elongated bolts 64*a*. Bolts 64 are attached by nuts 66**.

Figure 3:
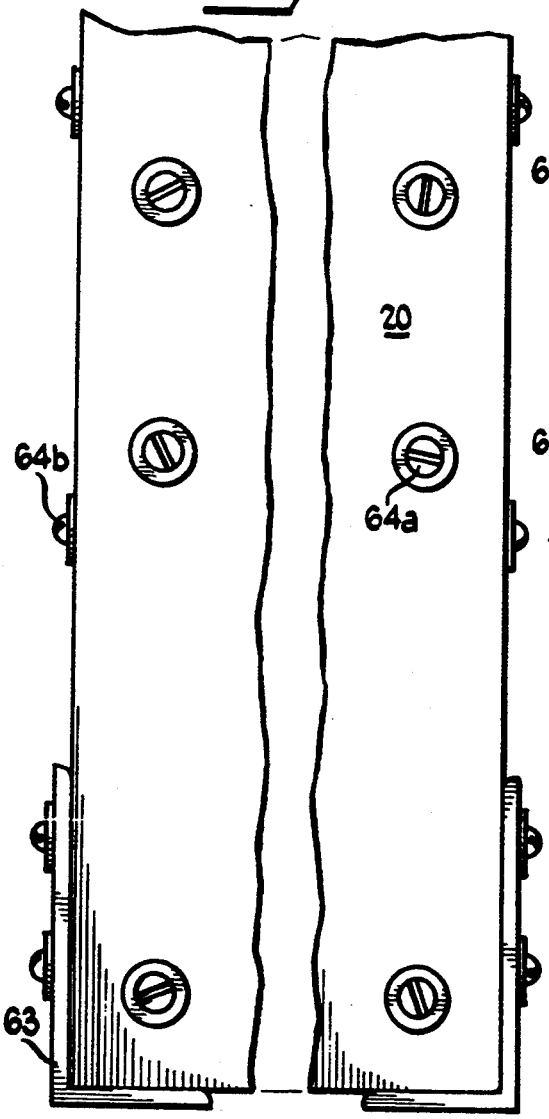
FIG. 3 is a broken front view of a wall section showing the outside surface of the wall section.

FIG. 3 a front view of wall section 10 as seen from the outside surface of the sections. Outer layer of gypsum board 20 is shown having elongated bolts 64*a* mounted therein. Further, side bolts 64*b* are seen holding section 10 in its assembled position. Section 10 is shown mounted to angled metal brackets 63.

Figure 4:
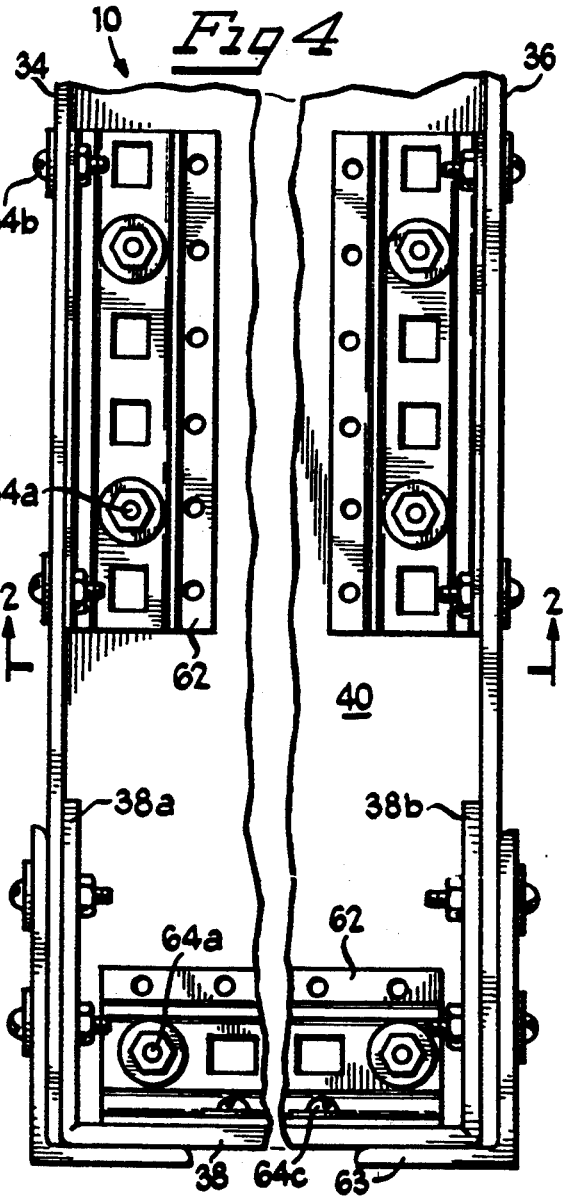
FIG. 4 is a broken-away back view of a wall section showing the inside surface of a section.

FIG. 4 is a back view of wall section 10 showing the inside surface of the section. Layer of foam 40 is shown surrounded by side flaps 34, 36, and bottom flap 38 of the layer of corrugated 30. Side flaps 34 and 36 are shown mounted in assembled position by side bolts 64*b* mounted in angled metal stays 62 which, in turn, are mounted to foam layer 40 by elongated bolts 64*a*. Bottom flap 38 is shown mounted in assembled position by bottom bolts 64*c* mounted in angled metal stay 62 which, in turn, is mounted to foam layer 40 by elongated bolts 64*a*. Further, bottom flap 38 includes flap ends 38*a* and 38*b* which are folded up in juxtaposition with side flaps 34 and 36, respectively and are mounted thereto by side bolts 64*b*. Section 10 is shown mounted to angled metal brackets 63. However, angled metal brackets 63 should be understood to illustrate additional adjacent sections and/or a building base support 15.

Figure 5:
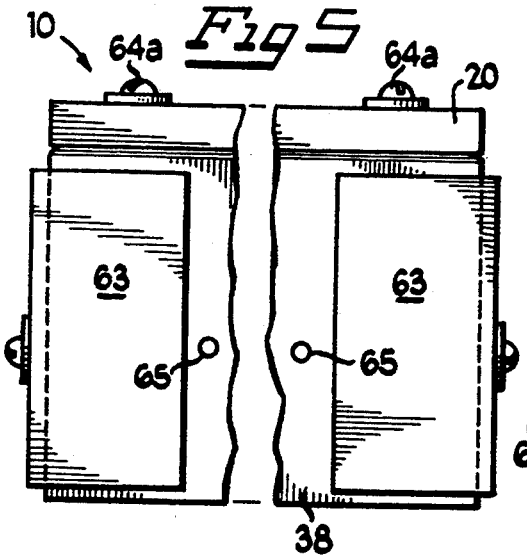
FIG. 5 is a broken-away bottom view of a wall section.

FIG. 5 shows a bottom view of wall section 10. Bottom flap 38 is seen including bolt ends 65 holding bottom flap 38 in its assembled position. Further seen in FIG. 5 is outer layer of gypsum board 20 having elongated bolts 64*a* therethrough. Bottom flap 38 is further illustrated as being mounted to angled metal brackets 63.

FIG. 6 shows a side view of wall section 10. Outer layer of gypsum board 20 is secured by elongated bolts 64*a*. Side flap 34 is shown mounted in its assembled position perpendicular to outer layer of gypsum board 20 by side bolts 64*b*.

FIG. 7 is an exploded perspective view of building wall section 10. As can be seen, outer layer of gypsum board 20 is laminated on main planar section 32 of corrugated layer 30, and foam layer 40 is laminated to the inner side of the main planar section 32 of corrugated layer 30 by any suitable adhesive means. These layers are secured together by elongated bolts 64*a* mounted in angled metal stays 62 by main nuts 66*a*. Side flaps 34 and 36 of the layer of corrugated 30 fold inward along fold lines 34*a* and 36*a*, respectively until perpendicular with gypsum board 20 and foam layer 40. Side flaps 34 and 36 are held in assembled position by side bolts 64*b* mounted in angled metal stays 62 by side nuts 66*b*. Bottom flap 38 is folded inward and upward along fold line 37*a* until perpendicular with the outer layer of gypsum board 20, the main planar section 32 and the foam layer 40. Bottom flap 38 is held in assembled position by bottom bolt 64*c* mounted in angled metal stays 62. Further, end sections 38*a* and 38*b* (see FIG. 9) of bottom flap 38 are folded along fold lines 37*b* and 37*c* (See FIG. 9), respectively until perpendicular with outer layer of gypsum board 20, main planar section 32, layer foam 40 and bottom flap 38 and juxtaposed with side flaps 34 and 36, respectively. End sections 38*a* and 38*b* are then mounted to side flaps 34 and 36, respectively by side bolts 64*b*.

FIG. 8 is a perspective view of wall section 10 in its partially assembled, pre-fabricated state in which outer layer of gypsum board 20, main planar section 32 and layer foam 40 are laminated together and secured by elongated bolts 64*a*. Side flaps 34, 36 and bottom flap 38 with end sections 38*a* and 38*b* remain unfolded until adjacent sections 10 are to be assembled during construction.

FIG. 9 is a top view of FIG. 8 showing outer layer of gypsum board 20, layer of corrugated 30 and layer of foam 40 laminated together. Side flaps 34 and 36 and bottom flap 38 with end sections 38*a* and 38*b* remain unfolded.

Figure 10:
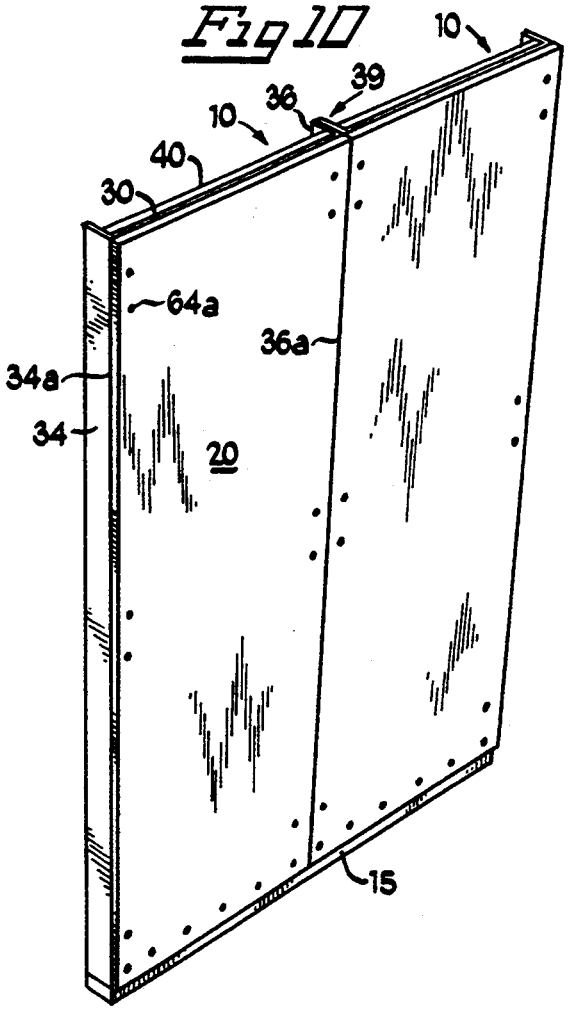
FIG. 10 is a perspective view of two wall sections mounted together as seen from the outside surface of the sections.

FIG. 10 is a perspective view as seen from the outside surface of wall section 10 with two wall sections 10 assembled to each other. As can be seen, the outer layer of gypsum board 20 is secured by elongated bolts 64*a* passing therethrough. Side flaps 34 and 36 of the layer of corrugated 30 are folded inward along fold lines 34*a* and 36*a* such that they are perpendicular with the gypsum board 20 and layer foam 40. Side flaps of adjacent building sections 10 are mounted together to form wall section stud 39. FIG. 10 further illustrates the two building wall sections 10 mounted to a building base support 15.

Figure 12:
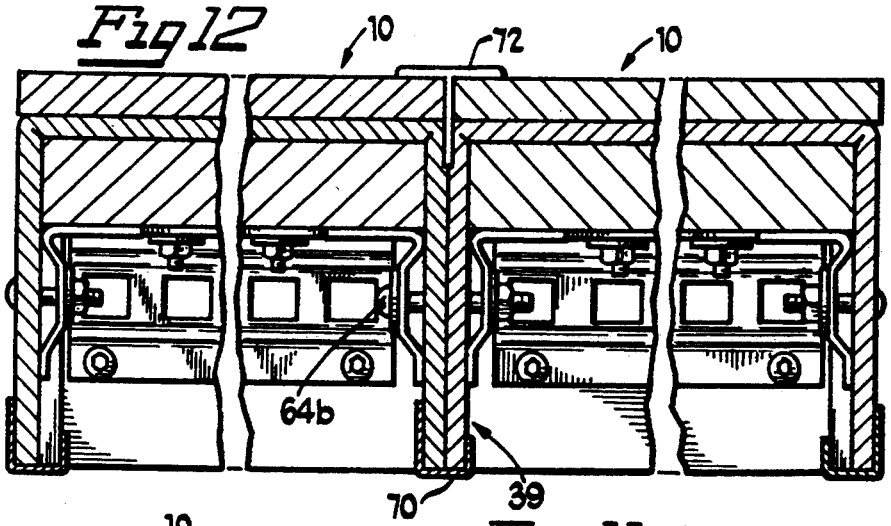
FIG. 12 is a broken top view of two wall sections mounted together.
Figure 11:
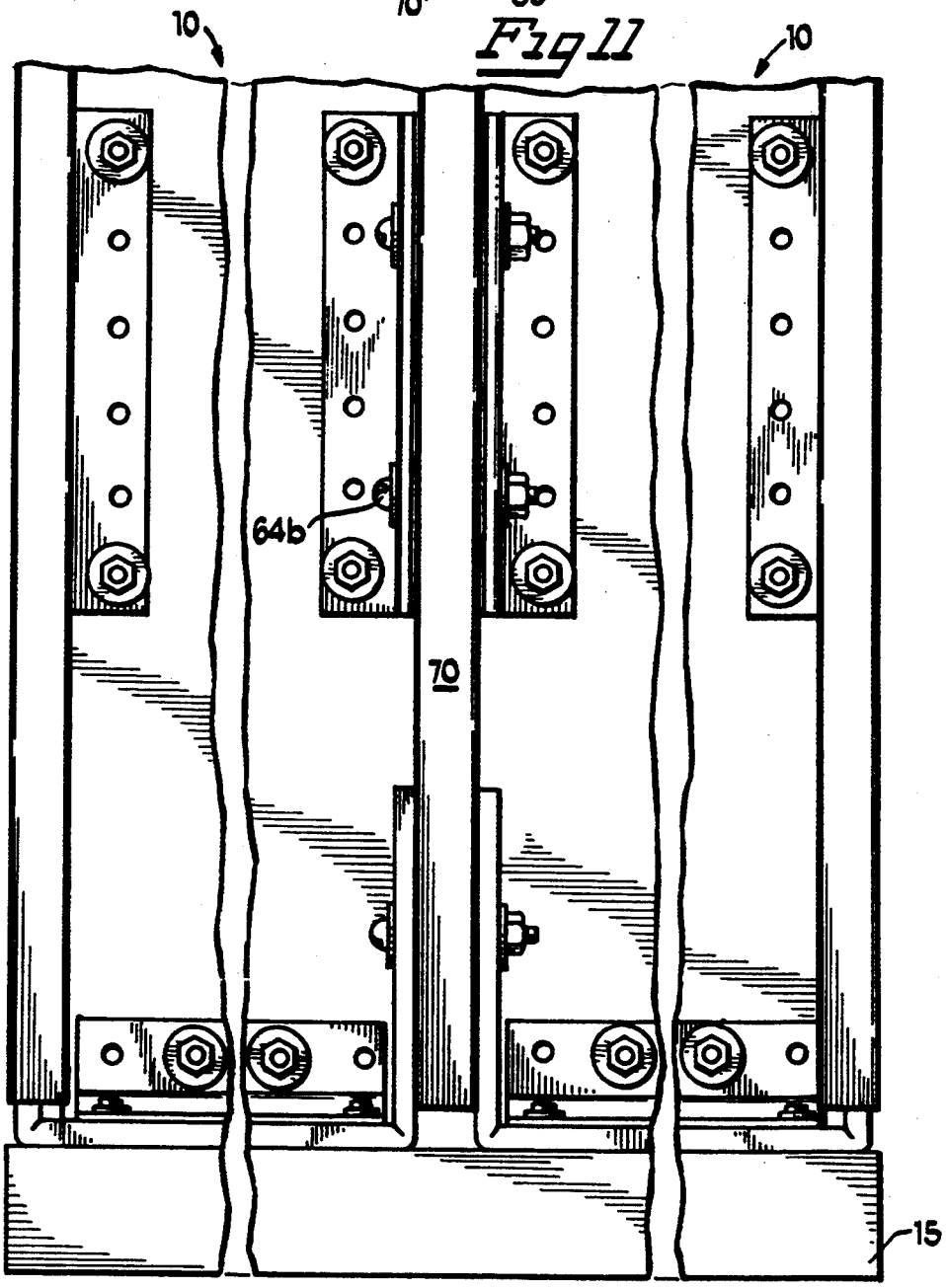
FIG. 11 is a broken back view of two wall sections mounted together as seen from the inside surface of the wall sections.

FIGS. 11–12 show a back view and a top view, respectively, of two wall sections 10 mounted together. As can be seen in FIG. 12, adjacent sides of each wall section 10 are mounted together by side bolts 64*b* to form wall section stud 39. Section stud 39 is covered with a J-shaped strip of plastic 70 running along the entire length of the section stud 39, as seen in FIG. 11. The two assembled wall sections 10 further include a strip of T-shaped plastic 72 placed between and partially covering gypsum boards 20 of the assembled wall sections to form a seal therebetween.

FIG. 13 shows a cross-section of the roof section 110 of the present invention wherein roof section 110 comprises an outer layer of gypsum board 120 laminated to a layer of corrugated 130, which is laminated to a layer of foam 140, which is laminated to an inner second layer of corrugated 150. Each layer of corrugated 130 and 150 comprises side flaps 134,136,154 and 156, respectively. Side flaps 134 and 136 are folded outward around the outer layer of gypsum board 120 until perpendicular to the outer layer of gypsum board 120. Side flaps 154 and 156 of the outer layer of corrugated 150 are folded outward around the foam layer 140 until perpendicular with the gypsum board 120 and foam layer 140, and juxtapositioned with the flaps 134 and 136.

Building roof section 110 is preferably used as a roofing section. Flaps 134 and 154 and flaps 136 and 156 when mounted adjacent an additional roof section 110, form a roof section stud 139 (see FIG. 18) between which a T-shaped section of plastic 172 (See FIG. 14) is placed to seal the adjacent sections.

FIG. 14 shows an exploded perspective view of the roof section 110 wherein outer layer of gypsum board 120 is laminated to a layer of corrugated 130 having side flaps 134 and 136, wall end flap 138, and roof top end flap 133, a layer of foam 140 and a second inner layer of corrugated 150 having side flaps 154 and 156 and a roof top end flap 153. The layer of gypsum board 120, layer of corrugated 130, layer of foam 140, and second layer of corrugated 150 are laminated or glued together and secured by elongated bolts 164*a* mounted through angled metal stays 162. Sides 134 and 154 are held in mounted position by side bolts 164*b* mounted through angled metal stays 162. Similarly, side flaps 136 and 156 are held in assembled position by side bolts 164*b* mounted through angled metal stays 162. T-shaped section 172 mounts between and over side flaps of adjacent sections 110.

Construction of section 10 is as follows. Layer of corrugated material 30 is completely painted with fire resisting paint. Layer of gypsum board 20 is juxtapositioned with main planar section 32 on one side of corrugated layer 30 and laminated thereto. Layer of foam 40 is juxtapositioned with main planar section 32 on the other side of corrugated layer 30 and laminated thereto. Holes for fasteners 60 are then drilled through layers 20, 30 and 40. To attach two sections together, corrugated flaps 34, 36 and 38 are folded along their respective fold lines as described above. The two sections are then placed side by side and the respective juxtapositioned side flaps are fastened together by side bolts 64*b*. Bottom flap 38 is anchored to building base support 15 by bottom bolts 64*c*.

Construction of section 110 is as follows. Layers of corrugated material 130 and 150 are completely painted with fire resisting paint. One side of foam layer 140 is juxtapositioned with and laminated to the main planar section of corrugated layer 150. The other side of foam layer 140 is juxtapositioned with and laminated to one side of the main planar section of corrugated layer 130. Gypsum board 120 is juxtapositioned with and laminated to the other side of the main planar section of corrugated layer 130. Holes for fasteners 60 are then drilled through layers 120, 130, 140 and 150. To attach two sections together, corrugated flaps 134, 136, 138, 154 and 156 are folded as described above. The two sections are then placed side by side and the respective juxtapositioned side flaps are fastened together by side bolts 164*b*.

Figure 15:
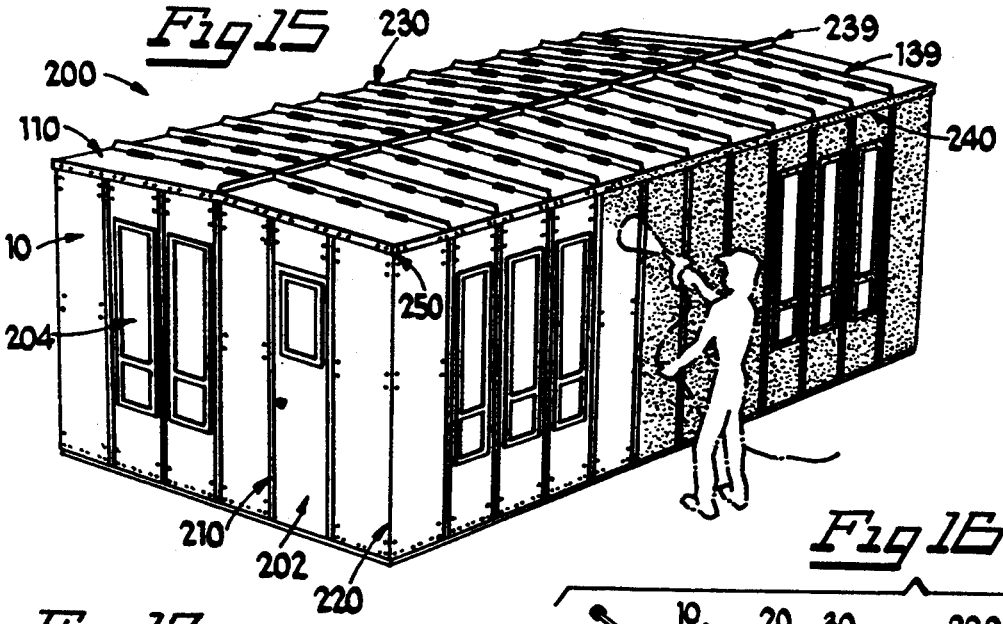
FIG. 15 is a perspective view of a building constructed as taught by the present invention.

FIG. 15 illustrates a building made from the wall and roof sections in the method of the present invention. Building 200 is comprised of a plurality of wall sections 10 mounted together and a plurality of roof sections 110 mounted together and attached to the wall sections 10 as will be described in more detail later. Building 200 is shown including door 202 and a plurality of windows 204. Also seen in FIG. 15 is a worker spray-painting building 200 with a fireproof paint 206. Building 200 comprises a plurality of wall connections 210 above-described in FIGS. 1, 10, 11 and 12, four wall corner connections 220, a plurality of roof connections 230, a plurality of roof wall connections 240, and four roof corner connections 250. Roof section studs 139 can be seen formed between adjacent sides of roof sections. Roof apex stud 239 can be seen running the length of the roof and formed between adjacent ends of roof sections.

Figure 16:
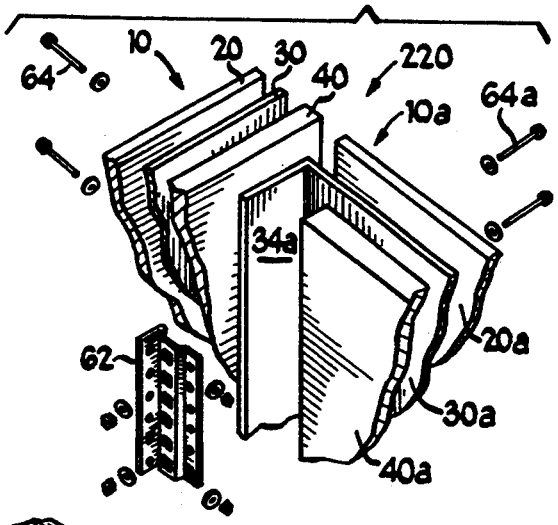
FIG. 16 is an exploded, partially broken-away perspective view of a wall-wall corner section of a building.
Figure 17:
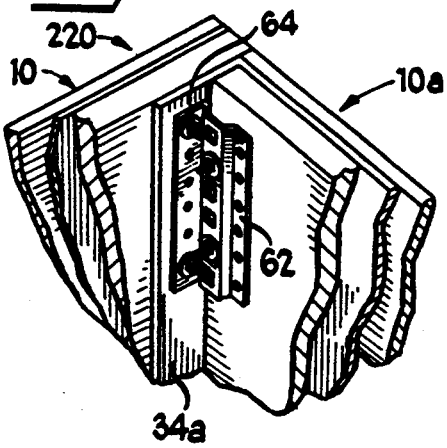
FIG. 17 is an assembled, partially broken away perspective view of a wall-wall corner section of a building.

FIGS. 16 and 17 illustrate the wall corner connections 220. As can be seen in FIG. 16, wall corner connection 220 is comprised of a first wall section 10 and a second section 10*a*. Wall section 10 is seen having gypsum board 20, layer of corrugated 30, and foam layer 40. Wall section 10*a* is shown having gypsum board 20*a*, layer of corrugated 30*a* having flap 34*a*, and foam layer 40*a*. To form wall corner connection 220, section 10 and wall section 10*a* are positioned perpendicular to each other at their ends thereof. Section 10 and 10*a* are then mounted together via angled metal stays 62 mounted to section 10*a* by elongated bolts 64*a* which pass through gypsum board 20*a*, layer of corrugated 30*a*, and foam layer 40*a*. Further, wall section 10 is mounted to angled bracket 62 by elongated bolts 64 which pass through gypsum board 20, corrugated layer 30, foam layer 40 and side flap 34*a* of section 10*a*.

FIG. 17 illustrates wall corner connection 220 in an assembled position. As can be seen, angled metal bracket 62 connects wall section 10 and wall section 10*a*. Side flange 34*a* of section 10*a* is securely fastened to wall section 10 by bolts 64 mounted in angled bracket 62.

Figure 18:
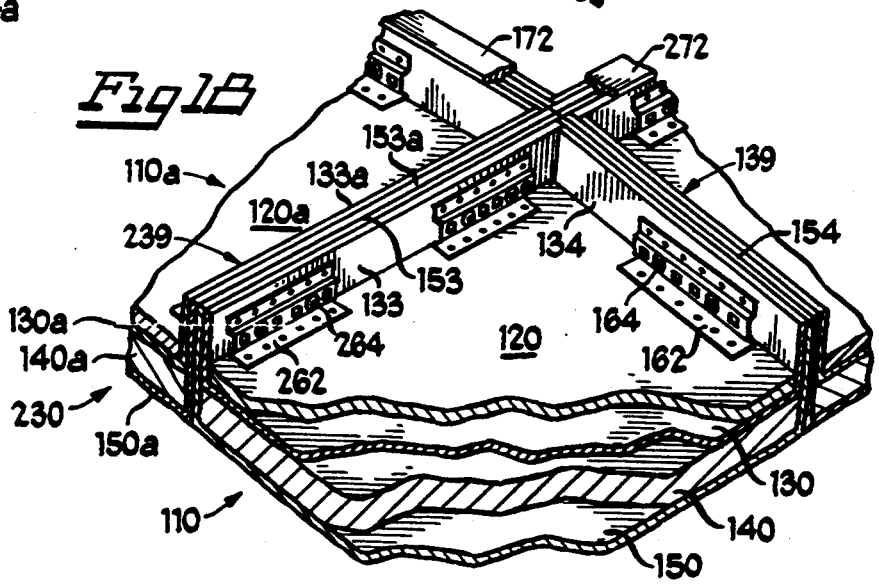
FIG. 18 is a partially broken away perspective view of a roof section of the present invention.

FIG. 18 illustrates the roof connection 230 wherein roof section 110 and roof section 110*a* are connected together by rooftop flaps 133, 153, 133*a*, and 153*a*. As can be seen, roof section 110 comprises gypsum board 120, a layer of corrugated 130, foam layer 140, and second inner layer of corrugated 150. Roof section 110*a* comprises gypsum board 120*a*, a layer of corrugated 130*a*, foam layer 140*a*, and second inner layer of corrugated 150*a*. Further, layer of corrugated 130 and layer of corrugated 150 include rooftop flaps 133 and 153, respectively. Similarly, layer of corrugated 130*a* and 150*a* includes rooftop flaps 133*a* and 153*a*, respectively. Sections 110 and 110*a* are placed end to end at their rooftop flap ends. Rooftop flaps 133, 153, 133*a*, and 153*a* are then mounted together using angled metal stays 262 and bolt 264. Adjacent roof sections 110 are mounted side by side by angled metal stays 162 and bolts 164 at flaps 134 and 154 to form the entire roof. Rooftop flaps 133, 153, 153*a* , and 133*a* form roof apex stud 239 which, when adjacent roof sections 110 are mounted together, runs the length of the entire building 200, as seen in FIG. 15. Side flaps 134 and 154 when mounted with the side flaps of an adjacent roof section 110 forms roof stud 139 (See FIG. 20). Roof studs 139 are covered by T-shaped plastic strips 172 while roof apex stud 239 is covered by a T-shaped plastic strip 272 to form rooftop seals.

Figure 19:
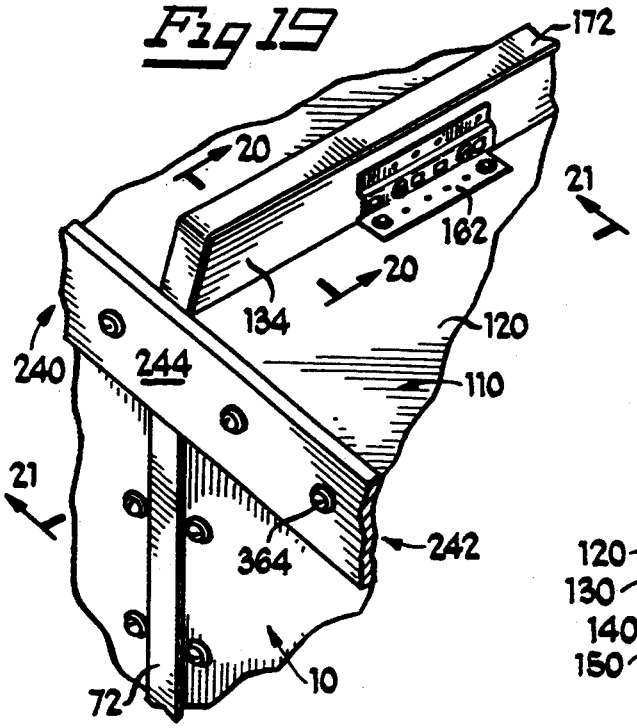
FIG. 19 is a partially broken away perspective view of finished roof and wall section of the present invention.
Figure 21:
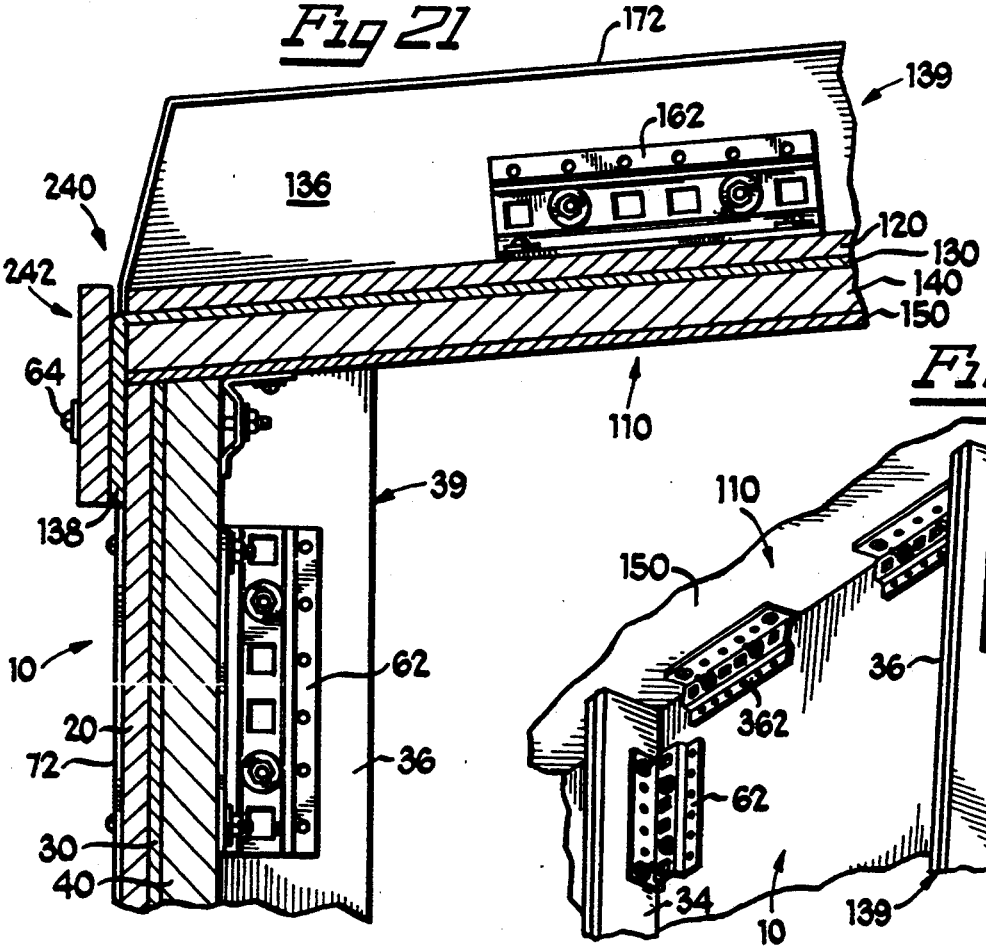
FIG. 21 is a partial cross-sectional view of a roof and wall section of the present invention.
Figure 24:
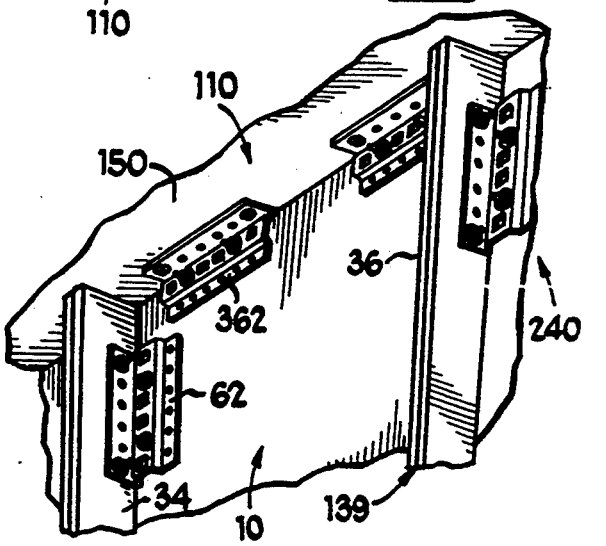
FIG. 24 is a perspective view of the roof-wall connection as seen from the building interior.

FIGS. 19, 21 and 24 illustrate the roof wall connection 240. As can be seen from the outside view depicted in FIG. 19, roof section 110 at its wall end connects with wall section 10 at its roof end. A roof wall edging 242 is placed at the connection of the roof section 110 and wall section 10. Roof wall edging 242 is preferably a long narrow strip of gypsum board 244. Gypsum board 244 is fastened through wall section 10 by bolts 364. Further seen in FIG. 19 is roof stud 139 having T-shaped plastic strip 172 therein, and T-shaped plastic strip 72 placed between adjacent wall sections 10. Roof wall connection 240 is more clearly seen in FIG. 21. Roof section 110 comprising gypsum board 120, layer of corrugated 130, foam layer 140, and inner second layer of corrugated 150 connects to wall section 10 comprising gypsum board 20, layer of corrugated 30, and foam layer 40 by angled metal stays 362. Further seen in FIG. 21 is wall stud 39 and roof stud 139. Roof stud 139 is covered by T-shaped plastic strip 172. T-shaped plastic strip 72 is shown on the outside of wall section 10 between wall sections. Roof wall edging 242 is shown covering the connection between roof section 110 and wall section 10. Gypsum board 244 is bolted through wall section 10 by bolts 364 in angled brackets 362.

Figure 20:
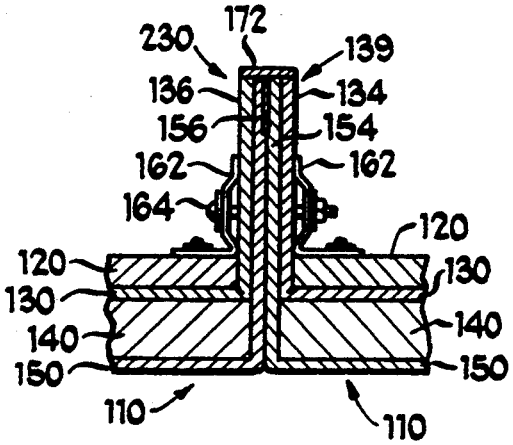
FIG. 20 is a broken away cross-sectional view of two roof sections assembled together side by side.

FIG. 20 shows roof connection 230 wherein adjacent roof sections 110 are connected to form roof section stud 139. As can be seen, flaps 134 and 154 of one roof section 110 are mounted to the flaps 136 and 156 of an adjacent roof section 110 to form roof section stud 139. The adjacent sections 110 are mounted together by bolt 164 placed through angled brackets 162, one on each side of the roof section stud 139. Further seen in FIG. 20 is T-shaped plastic strip 172 placed over and between side flaps 134,154, 136, and 156 to form the rooftop seals.

FIG. 22 illustrates roof corner connection 250 wherein roof section 110 is connected to a wall corner 220. Wall corner 220 is formed as above-described in FIGS. 16 and 17 with wall section 10 connecting with wall section 10*a* perpendicularly. Roof section 110 is easily attached to wall corner 220 by angled metal stays 362 mounted on wall section 10 and wall section 10*a*. Gypsum board 244 is shown on the outside of the wall connection 210. Wall sections 10, 10*a* and roof section 110 are fastened together by bolts 364 placed through sections 10, 110 and 10*a* and into angled metal stays 362.

FIG. 23 illustrates the building interior 260. As can be seen, wall sections 10 mount together at wall connections 210. Wall sections 10 and roof sections 110 are mounted together at roof wall connections 240. Further seen in building interior 260 is roof corner connection 250. Sections 10 and 110 are mounted together by angled metal stays 362. Wall studs 39 can be seen on the inside building interior 260. Also seen in FIG. 23 is ceiling beam 270. Ceiling beam 270 runs the entire length of the roof parallel with roof apex stud 239. Ceiling beam 270 is held to the ceiling by J-shaped beam supports 272 mounted directly into the ceiling and wall brackets 274 mounted to the wall sections 10 at the ends of the beam 270. Preferably, building interior 260 has three equally spaced ceiling beams 270 running the entire length of the ceiling, one at the roof apex.

FIG. 24 illustrates roof wall connection 240 from the building interior. Wall section 10 can be seen including foam layer 40 between side flaps 34 and 36. Side flaps 34 and 36 mount with adjacent side flaps of adjacent wall sections 10 to form wall stud 139. Adjacent wall sections 10 are mounted together by angled metal stays 62. Further roof section 110 can be seen mounted to wall section 10 by angled metal stays 362. Roof section 110 can be seen including inner second layer of corrugated 150.

FIG. 25 is a cross-sectional view of ceiling beam 270. Ceiling beam 270 is preferably two 2×6 wooden boards or one 4×6 wooden board spanning the entire length of the ceiling. Ceiling beam 270 rests in a plurality of J-shaped beam supports 274 which are evenly spaced across the length of the ceiling. J-shaped beam supports 274 are mounted directly into roof sections 110 by bolts 64. Roof stud 139 is also seen in FIG. 25.

Before construction, interior and exterior surface of sections 10 and 110, including the corrugated flaps, are coated with a fire-retardant material (i.e. paint) to make sections 10 and 110 completely fireproof and prevent spontaneous combustion. Fire resistancy is preferably obtained by the use of Tough/Coat fire resisting paints, manufactured by Space Age Technology Products, Inc. of Chicago, Ill., used as a primer coat for the corrugated material. The Tough/Coat paints also give a water-resistancy to and strengthen and stiffen the corrugated material.

All building sections will be pre-drilled to allow for simple and fast construction. A builder only need use basic bolt fastening tools. The sections of the present invention can be cut to accommodate windows, doors, etc. The layers of the present invention can be fastened together in any suitable manner. Preferably, the layers are laminated or glued to one another by any suitable adhesive means, prior to the drilling of holes for fasteners 60, 160.

The sections 10, 110 can be used in the construction of building or other structures. Construction using sections 10, 110 is fast, safe and efficient and can be achieved at a far less expense than present construction material. Sections 10,110 could be any shape or size but preferably are two foot wide panels with a length approximately that of a wall board or plastic board.

The wall sections 10 which form the short sides of building 200, perpendicular to roof apex stud 239, are preferably successively cut at a rising slope at their roof ends. These wall sections are cut in this manner to provide a sloped roof once the roof sections 110 are attached. The slope of the roof can vary as desired. Sections 10 and 110 can be modified slightly as desired or needed to ensure proper fit or connection. For example, a side flap could be cut-off at a wall corner connection to ensure proper connection.

Building 200 could be any size or shape. The windows of the building are preferably made from acrylic, not glass. The ceiling beam could be a pipe instead of wooden beams. The T-shaped and J-shaped plastic strips are held in place by any suitable fastening means, such as a screw.

It is to be understood that the embodiments herein described are merely for illustrative of the principles of the present invention. Various modifications may me made by those skilled in the art without departing from spirit or scope of the claims which follow.

I claim:

1. A structure comprising:

a plurality of wall sections, said wall sections comprising:

a rigid fire-retardant layer, a layer of corrugated material having a main planar surface and two substantially identical side flaps, said main planar surface being juxtapositioned with and attached to said fire-retardant layer, said side flaps extending a short distance from said main planar surface and being positioned perpendicular to said main planar surface to form structural studs of a substantially C-shaped wall member, a layer of foam material juxtapositioned with and attached to said layer of corrugated material opposite said rigid fire-retardant layer, and a plurality of L-shaped fasteners for holding said side flaps in position, said side flaps solely constituting said structural studs when held in position with said fasteners;

a plurality of roof sections, said roof sections comprising:

a rigid fire-retardant layer, a first layer of corrugated material having a main planar surface, two substantially identical side flaps, and a roof top flap, said main planar surface juxtapositioned with and attached to said fire-retardant layer, said side flaps extending a short distance from said main planar surface and being positioned perpendicular to said main planar surface to form structural studs of a substantially C-shaped roof member, a layer of foam material juxtapositioned with and attached to said first layer of corrugated material opposite said fire-retardant layer, and a second layer of corrugated material having a main planar surface, two substantially identical side flaps, and a roof top flap, said main planar surface juxtapositioned with and attached to said layer of foam material opposite said first layer of corrugated material, said side flaps extending a short distance from said main planar surface and being positioned perpendicular to said main planar surface and juxtapositioned with said side flaps of said first layer of corrugated material to form structural studs of a substantially C-shaped roof member, and a plurality of L-shaped fasteners for holding said side flaps in position, said side flaps solely constituting said structural studs when held in position with said fasteners; and means for fastening said wall sections and said roof sections to form said structure.

2. The structure of claim 1, wherein said fire-retardant layer of said wall sections and said roof sections is gypsum board.

3. The structure of claim 1, wherein said fire-retardant layer, said layer of corrugated material and said layer of foam material of said wall sections are laminated together, and said fire-retardant layer, said first layer of corrugated material, said layer of foam material and said second layer of corrugated material of said roof sections are laminated together.

4. The structure of claim 1, wherein said layer of corrugated material of said wall sections, and said first and second layer of corrugated material of said roof sections are corrugated cardboard.

5. The structure of claim 1, wherein said layer of corrugated material of said wall sections, and said first and second layer of corrugated material of said roof sections are coated with fire resisting paint.

6. The structure of claim 1, wherein said roof top flaps of said first and said second layer of corrugated material are folded perpendicular to said rigid fire-retardant layer of said roof sections and juxtapositioned with each other to form a roof apex stud.

7. The structure of claim 1, wherein said roof sections and said wall sections are connected at roof-wall connections, said roof-wall connections covered by a roof-wall edging.

8. The structure of claim 7, wherein said roof-wall edging is a long narrow strip of gypsum board.

9. The structure of claim 1, wherein said structure has an interior ceiling, said interior ceiling having at least one ceiling beam spanning a length of said ceiling.

10. A fire resistant structure having a base support, comprising:

a plurality of pre-fabricated wall sections, said wall sections comprising:

an outer layer of gypsum board, a layer of corrugated cardboard having a main planar surface and two substantially identical side flaps, said main planar surface being juxtapositioned with and attached to said gypsum board, and an inner layer of foam material juxtapositioned with and attached to said layer of cardboard opposite said outer layer of gypsum board, said side flaps of said layer of cardboard positioned perpendicular to and around said layer of foam material to form wall studs;

a plurality of pre-fabricated roof sections, said roof sections comprising:

an outer layer of gypsum board, a first layer of corrugated cardboard having a main planar surface, two substantially identical side flaps, and a roof top flap, said main planar surface being juxtapositioned with and attached to said gypsum board, a layer of foam material juxtapositioned with and attached to said first layer of cardboard opposite said outer layer of gypsum board, and an inner second layer of corrugated cardboard having a main planar surface, two substantially identical side flaps, and a roof top flap, said main planar surface being juxtapositioned with and attached to said layer of foam opposite said first layer of corrugated cardboard, said side flaps of said first and said second layer of cardboard positioned perpendicular to and around said gypsum board and juxtapositioned with each other to form roof studs, said roof top flap of said first and said second layer of cardboard positioned perpendicular to and around said gypsum board and juxtapositioned with each other to form a roof apex stud; and means for securing said wall sections and said roof sections together to form said structure, said means for securing comprising a plurality of angled metal stays.

11. The fire resistant structure of claim 10, wherein said layer of corrugated cardboard of said wall sections further includes a bottom flap, said bottom flap extending a short distance away from said main planar surface and being positioned perpendicular to said layer of foam material and said side flaps, said bottom flap being held in position by said means for securing, said wall sections being mounted to said base support via said bottom flap.

12. The fire resistant structure of claim 10, wherein said first layer of corrugated cardboard of said roof sections further includes a wall end flap, said wall end flap extending a short distance away from said main planar surface and being positioned substantially perpendicular to said layer of foam material and said side flaps, said wall end flap being held in position by said means for securing, said roof sections being mounted to said wall sections via said wall end flap.

13. The structure of claim 10, wherein said layer of cardboard of said wall sections, and said first and second layer of cardboard of said roof sections are coated with fire resisting paint.

14. The structure of claim 10, wherein said roof sections and said wall sections are connected at roof-wall connections, said roof-wall connections covered by a roof-wall edging.

15. The structure of claim 10, wherein said structure has an interior ceiling having at least one ceiling beam spanning a length of said ceiling.

16. The structure of claim 10, wherein said wall sections and said roof sections include pre-drilled holes for receiving said means for securing.

17. A method of constructing structures comprising the steps of:

providing a plurality of wall sections comprising a rigid fire-retardant layer juxtapositioned with and attached to a layer of corrugated material having a main planar surface and two substantially identical side flaps, and juxtapositioned with and attached to a layer of foam material opposite said rigid fire-retardant layer, said side flaps being positioned perpendicular to and around said layer of foam material to form wall studs;

providing a plurality of roof sections comprising a rigid fire-retardant layer juxtapositioned with and attached to a first layer of corrugated material having a main planar surface, two substantially identical side flaps, and a roof top flap, and juxtapositioned with and attached to a layer of foam material opposite said layer rigid fire-retardant layer, and juxtapositioned with and attached to a second layer of corrugated material opposite said first layer of corrugated material and having a main planar surface, two substantially identical side flaps, and a roof top flap, said side flaps being positioned perpendicular to and around said rigid fire-retardant layer and juxtapositioned with each other to form roof studs, said roof top flaps of said first and second layer of corrugated material positioned perpendicular to and around said rigid fire retardant layer and juxtapositioned with each other to form a roof apex stud; and attaching said wall sections and said roof sections together to from said structure.

18. The method of claim 17, wherein said step of attaching comprises the steps of:

positioning said side flaps of said layer of corrugated material of said wall sections perpendicular to and around said layer of foam material to form wall studs; and attaching said plurality of wall sections together at said wall studs to form a wall.

19. The method of claim 18, wherein said step of attaching further comprises the steps of:

attaching said plurality of roof sections together at said roof studs and said roof apex stud to form a roof.

20. The method of construction of claim 17, wherein said layer of corrugated material of said wall sections further includes a bottom flange, said method further comprising the steps of:

positioning said bottom flange of said corrugated material of said wall section perpendicular to and around said layer of foam material and perpendicular to said side flaps; and securing said bottom flange in position via L-shaped metal stays.

* * * * *